US011645989B2

(12) United States Patent
Huang

(10) Patent No.: US 11,645,989 B2
(45) Date of Patent: May 9, 2023

(54) DRIVING CIRCUIT, DRIVING METHOD AND DISPLAY PANEL

(71) Applicants: CHONGQING HKC OPTOELECTRONIC TECHNOLOGY CO.,LTD., Chongqing (CN); HKC CORPORATION LIMITED, Shenzhen (CN)

(72) Inventor: Xiao Yu Huang, Chongqing (CN)

(73) Assignees: CHONGQING HKC OPTOELECTRONICS TECHNOLOGY CO., LTD., Chongqing (CN); HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/939,989

(22) Filed: Sep. 8, 2022

(65) Prior Publication Data

US 2023/0005442 A1 Jan. 5, 2023

Related U.S. Application Data

(62) Division of application No. 16/340,384, filed on Apr. 9, 2019, now Pat. No. 11,475,856.

(51) Int. Cl.

| | |
|---|---|
| ***G09G 3/36*** | (2006.01) |
| ***G09G 3/3266*** | (2016.01) |
| ***G09G 3/3275*** | (2016.01) |

(52) U.S. Cl.

CPC ..... *G09G 3/3607* (2013.01); *G09G 3/3266* (2013.01); *G09G 3/3275* (2013.01); *G09G 3/3614* (2013.01); *G09G 3/3677* (2013.01); *G09G 3/3688* (2013.01); *G09G 2300/0852* (2013.01); *G09G 2310/0278* (2013.01); *G09G 2320/046* (2013.01)

(58) Field of Classification Search

CPC .. G09G 3/3607; G09G 3/3266; G09G 3/3275; G09G 3/3614; G09G 3/3677; G09G 3/3688; G09G 2300/0852; G09G 2310/0278; G09G 2320/046

See application file for complete search history.

(56) References Cited

U.S. PATENT DOCUMENTS

| | | | | |
|---|---|---|---|---|
| 2003/0043127 | A1* | 3/2003 | Satoh | G09G 3/3216 345/204 |
| 2004/0041763 | A1* | 3/2004 | Kodama | G09G 3/3688 345/87 |
| 2006/0007195 | A1* | 1/2006 | Hu | G09G 3/3648 345/204 |
| 2007/0013573 | A1* | 1/2007 | Hashimoto | G09G 3/3614 341/172 |
| 2012/0086682 | A1* | 4/2012 | Shi | G09G 3/3688 345/204 |
| 2013/0120349 | A1* | 5/2013 | Oh | G09G 3/3688 345/212 |
| 2014/0159798 | A1* | 6/2014 | Duan | G09G 3/3611 327/434 |

* cited by examiner

*Primary Examiner* — David Tung

(57) ABSTRACT

The present application discloses a driving circuit, a driving method, and a display panel. The driving circuit includes: a plurality of pixels, each pixel including a first sub-pixel and a second sub-pixel; and a switching circuit, configured to communicate one or both of the first sub-pixel and the second sub-pixel with a scan line and a data line.

9 Claims, 6 Drawing Sheets

DRIVING CIRCUIT, DRIVING METHOD AND DISPLAY PANEL

CROSS REFERENCE OF RELATED APPLICATIONS

This application is a Divisional of U.S. patent application Ser. No. 16/340,384 filed on Apr. 9, 2019. This application claims the priority to the Chinese Patent Application No. CN201811054995.4, filed with National Intellectual Property Administration, PRC on Sep. 11, 2018 and entitled "DRIVING CIRCUIT, DRIVING METHOD AND DISPLAY PANEL", which is incorporated herein by reference in its entirety.

TECHNICAL FIELD

The present application relates to the technical field of display, and more particularly, to a driving circuit, a driving method and a display panel.

BACKGROUND

The statements herein merely provide background information related to the present application and do not necessarily constitute the prior art.

With the development and advancement of technologies, a liquid crystal display has become a mainstream product of display due to its thin body, power-saving, low radiation and the like, and thus has been widely used. Most of the liquid crystal displays currently available on the market are backlight liquid crystal displays, which include a liquid crystal panel and a backlight module. The working principle of the liquid crystal panel is to place liquid crystal molecules in two parallel glass substrates, and apply driving voltages on the two glass substrates to control the rotation direction of the liquid crystal molecules to refract the light of the backlight module to generate a picture.

Organic Light-Emitting Diode (OLED) is an advanced technique of current flat-panel display, and has become an important research direction in modern IT and video products. The main driving principle of the OLED is: a system mainboard connects an R/G/B compression signal, a control signal and a power supply to a connector on a PCB board through a wire. Data is processed by a Timing Controller (TCON) IC on the PCB board, passes through the PCB board, and is connected to a display region through a Source-Chip on Film (S-COF) and a Gate-Chip on Film (G-COF), so that the screen display obtains the required power and signals.

Therefore, the OLED is correspondingly improved, for example, techniques such as a display driving architecture for the OLED are a research method that is highly sought by those skilled in the art.

SUMMARY

In view of the drawbacks of the foregoing exemplary technique, the present application provides a driving circuit, a driving method, and a display panel that are beneficial to save scan lines and/or data lines.

To achieve the foregoing objective, the present application provides a driving circuit, including:

a plurality of pixels, each pixel including a first sub-pixel and a second sub-pixel;

a scan line connected to gate terminals of the first sub-pixel and second sub-pixel;

a data line connected to source terminals of the first sub-pixel and second sub-pixel; and a switching circuit configured to switch connection relations of the scan line, the data line, the first sub-pixel and the second sub-pixel so that one or both of the first sub-pixel and the second sub-pixel communicate with the scan line and the data line.

The first sub-pixel and the second sub-pixel are connected to the same scan line and the same data line.

According to the driving circuit of the present application, the first sub-pixel and the second sub-pixel are respectively connected to the same scan line and the same data line, and a switching circuit is provided to switch the conduction relations of the first sub-pixel and the second sub-pixel to the scan line and the data line. In this way, during operation, the driving circuit can control that one of the sub-pixels is connected to the scan line and the data line, and the other sub-pixel is not connected, or the two sub-pixels are connected to the scan line and the data line. In this way, the first sub-pixel and the second sub-pixel are controlled to operate respectively through a scan line and a data line, thereby saving the use of the scan line and the data line. Moreover, if necessary, one of the first sub-pixel and the second sub-pixel is disconnected to the scan line and the data line, and thus, the problem of "burn-in" caused by displaying the same image with the first sub-pixel and the second sub-pixel for a long time can be reduced, thereby prolonging the service life of the display panel.

BRIEF DESCRIPTION OF DRAWINGS

The drawings are included to provide understanding of embodiments of the present application, which constitute a part of the specification and illustrate the embodiments of the present application, and describe the principles of the present application together with the text description. Apparently, the accompanying drawings in the following description show merely some embodiments of the present application, and a person of ordinary skill in the art may still derive other accompanying drawings from these accompanying drawings without creative efforts. In the accompanying drawings.

DETAILED DESCRIPTION

Figure 1:
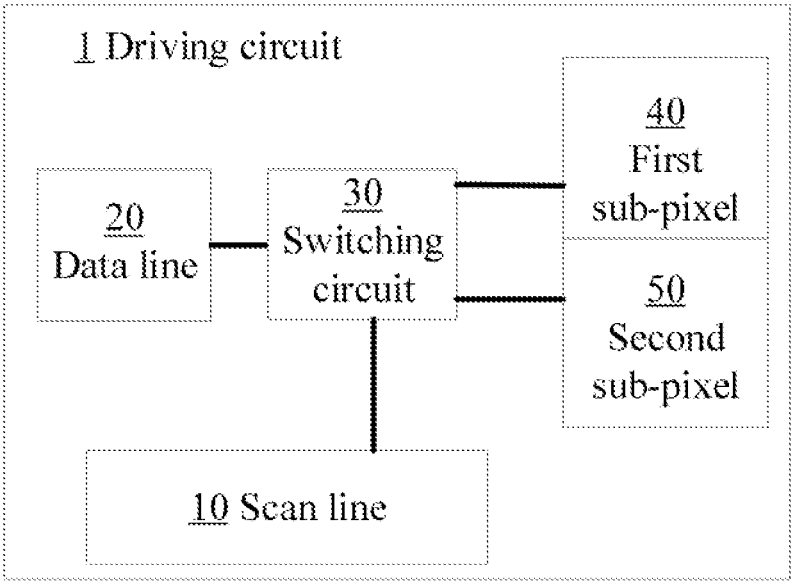
FIG. 1 is a schematic diagram of a driving circuit according to an embodiment of the present application.

The specific structure and function details disclosed herein are merely representative, and are intended to describe exemplary embodiments of the present application. However, the present application can be specifically embodied in many alternative forms, and should not be interpreted to be limited to the embodiments described herein.

In the description of the present application, it should be understood that, orientation or position relationships indicated by the terms "center", "transversal", "upper", "lower", "left", "right", "vertical", "horizontal", "top", "bottom", "inner", "outer", etc. are based on the orientation or position relationships as shown in the drawings, for ease of the description of the present application and simplifying the description only, rather than indicating or implying that the indicated device or element must have a particular orientation or be constructed and operated in a particular orientation. Therefore, these terms should not be understood as a limitation to the present application. In addition, the terms such as "first" and "second" are merely for a descriptive purpose, and cannot be understood as indicating or implying a relative importance, or implicitly indicating the number of the indicated technical features. Hence, the features defined by "first" and "second" can explicitly or implicitly include one or more features. In the description of the present application, "a plurality of" means two or more, unless otherwise stated. In addition, the term "include" and any variations thereof are intended to cover a non-exclusive inclusion.

In the description of the present application, it should be understood that, unless otherwise specified and defined, the terms "install", "connected with", "connected to" should be comprehended in a broad sense. For example, these terms may be comprehended as being fixedly connected, detachably connected or integrally connected; mechanically connected or electrically connected; or directly connected or indirectly connected through an intermediate medium, or in an internal communication between two elements. The specific meanings about the foregoing terms in the present application may be understood by a person of ordinary skill in the art according to specific circumstances.

The terms used herein are merely for the purpose of describing the specific embodiments, and are not intended to limit the exemplary embodiments. As used herein, the singular forms "a", "an" are intended to include the plural forms as well, unless otherwise indicated in the context clearly. It will be further understood that the terms "comprise" and/or "include" used herein specify the presence of the stated features, integers, steps, operations, elements and/or components, but do not preclude the presence or addition of one or more other features, integers, steps, operations, elements, components and/or combinations thereof.

The present application is further described below with reference to the accompanying drawings and preferred embodiments.

Figure 2:
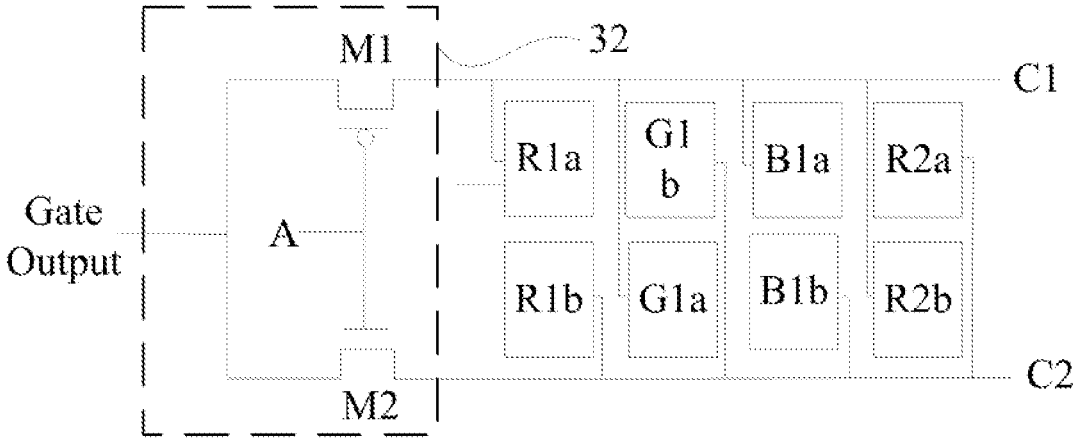
FIG. 2 is a circuit diagram of a driving circuit according to an embodiment of the present application.
Figure 3:
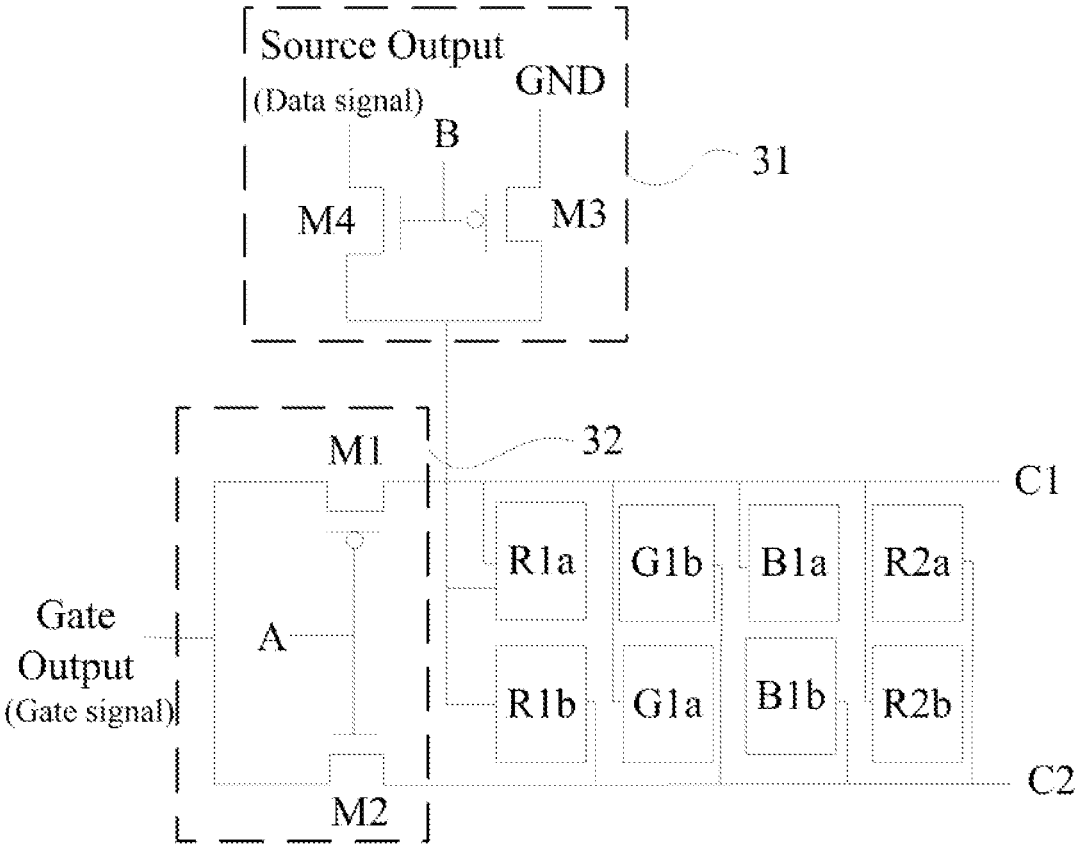
FIG. 3 is a circuit diagram of a driving circuit according to another embodiment of the present application.
Figure 4:
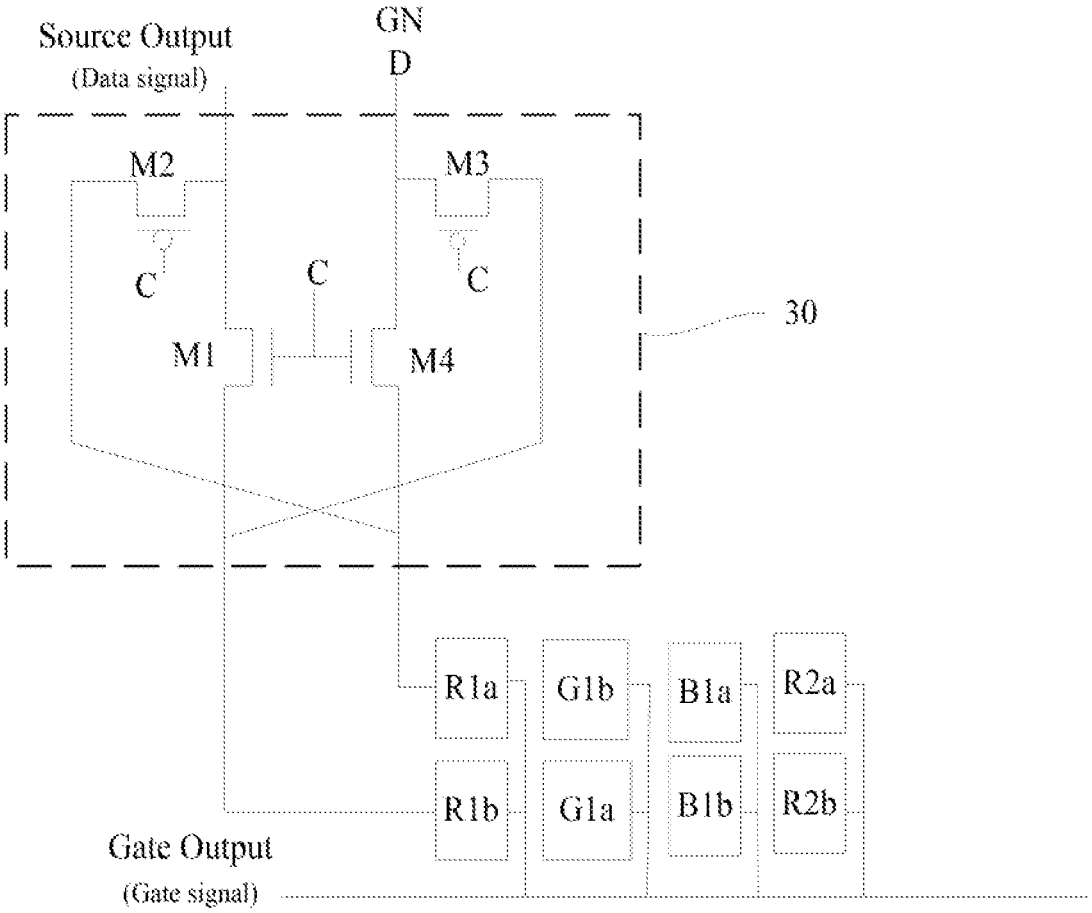
FIG. 4 is a circuit diagram of another driving circuit according to an embodiment of the present application.

FIG. 1 is a schematic diagram of a driving circuit according to the present application; FIG. 2 is a circuit diagram of a driving circuit according to an embodiment of the present application; FIG. 3 is a circuit diagram of a driving circuit according to another embodiment of the present application; and FIG. 4 is a circuit diagram of another driving circuit according to an embodiment of the present application. As shown in FIGS. 1-4, an embodiment of the present application discloses a driving circuit 1, including:

a plurality of pixels, each pixel including a first sub-pixel 40 and a second sub-pixel 50;

a scan line 10 connected to gate terminals of the first sub-pixel 40 and second sub-pixel 50;

a data line 20 connected to source terminals of the first sub-pixel 40 and second sub-pixel 50; and a switching circuit 30 configured to switch connection relations of the scan line 10, the data line 20, the first sub-pixel 40 and the second sub-pixel 50 so that one or both of the first sub-pixel 40 and the second sub-pixel 50 communicate with the scan line 10 and the data line 20.

According to the driving circuit of the present application, the first sub-pixel and the second sub-pixel are respectively connected to the same scan line and the same data line, and a switching circuit is provided to switch the conduction relations of the first sub-pixel and the second sub-pixel to the scan line and the data line. In this way, during operation, the driving circuit can control that one of the sub-pixels is connected to the scan line and the data line, and the other sub-pixel is not connected, or the two sub-pixels are connected to the scan line and the data line. In this way, the first sub-pixel and the second sub-pixel are controlled to operate respectively through a scan line and a data line, thereby saving the use of the scan line and the data line. Moreover, if necessary, one of the first sub-pixel and the second sub-pixel is disconnected to the scan line and the data line, and thus, the problem of "burn-in" caused by displaying the same image with the first sub-pixel and the second sub-pixel for a long time can be reduced, thereby prolonging the service life of the display panel.

Optionally, in this embodiment, the pixel further includes a third sub-pixel, a fourth sub-pixel, a fifth sub-pixel, and a sixth sub-pixel.

The first sub-pixel 40 and the second sub-pixel 50 are red sub-pixels; the third sub-pixel and the fourth sub-pixel are green sub-pixels; and the fifth sub-pixel and the sixth sub-pixel are blue sub-pixels.

In this solution, two sub-pixels are used as one pixel, for example, two red sub-pixels are used as one pixel for architecture, and are respectively connected to the scan line and the data line through the switching circuit; under the control of the switching circuit, one or both of the two red sub-pixels are simultaneously connected to the scan line and the data line, so that the two red sub-pixels can be disconnected to the scan line and the data line if necessary, while saving the scan line and the data line, to avoid the problem of "burn-in" caused by displaying the same image with the red sub-pixels for a long time; of course, the sub-pixels may also be green sub-pixels, blue sub-pixels, or even white sub-pixels, and yellow sub-pixels, if appropriate.

Optionally, in this embodiment, the first sub-pixel 40 and the second sub-pixel 50 respectively include a red sub-pixel, a green sub-pixel, and a blue sub-pixel.

In this solution, two sub-pixels are used as one pixel, for example, two red sub-pixels, two green sub-pixels, and two blue sub-pixels are used as one pixel for architecture, and are divided into two groups to be respectively connected to the scan line and the data line through the switching circuit, under the control of the switching circuit, one or both of the two sub-pixels are simultaneously connected to the scan line and the data line, so that the two sub-pixels can be disconnected to the scan line and the data line if necessary, while saving the scan line and the data line, to avoid the problem of "burn-in" caused by displaying the same image with the sub-pixels for a long time; of course, the sub-pixels may not necessarily on the same row, for example, the first row of pixels includes a first red sub-pixel, a first green sub-pixel, and a first blue sub-pixel; and the second row of pixels includes a second red sub-pixel, a second green sub-pixel, and a second blue sub-pixel; moreover, the first sub-pixel may include a first red sub-pixel, a second sub-pixel, and a first sub-pixel; and the second sub-pixel may include a second red sub-pixel, a first sub-pixel, and a second sub-pixel; of course, other pixel architectures are also possible, and can be flexibly set according to actual conditions, if appropriate.

Because of the self-luminous characteristics of the OLED, displaying the same image for a long time would cause the material characteristic attenuation rate of corresponding pixel to be different from that of the remaining pixels, so that the same current is input, and the display brightness of two types of pixels is different, resulting in an imprint that cannot be eliminated, i.e., the so-called "burn-in". To better solve the technical problem of "burn-in", the application makes improvement to obtain the following solution.

Optionally, in this embodiment, the switching circuit 30 includes a gate switching circuit 32, and a gate switching signal A for controlling the gate switching circuit 32.

The gate switching circuit 32 includes a first transistor M1, a second transistor M2, a first storage capacitor C1, and a second storage capacitor C2; the first transistor M1 is a transistor with a control terminal in negative polarity conduction; and the second transistor M2 is a transistor with a control terminal in positive polarity conduction.

A source electrode of the first transistor M1 is connected to the scan line 10, and a drain electrode thereof is connected to the first storage capacitor C1 and the gate terminal of the first sub-pixel.

A source electrode of the second transistor M2 is connected to the scan line 10, and a drain electrode thereof is connected to the second storage capacitor C2 and the gate terminal of the second sub-pixel.

Gate electrodes of the first transistor M1 and second transistor M2 are connected to each other, and are connected to the gate switching signal A.

The scan line 10 receives a gate signal (Gate Output); and the data line 20 transmits a data signal (Source Output).

The transistor generally refers to a metal-oxide-semiconductor field effect transistor, i.e., an MOS tube, and of course, may also be other components of similar function, where the transistor with a control terminal in negative polarity conduction is a P-channel MOS tube, i.e., P-MOS, and the transistor with a control terminal in positive polarity conduction is an N-channel MOS tube, i.e., N-MOS.

In this solution, the switching circuit includes a gate switching circuit, where the first sub-pixel and the second sub-pixel are separately connected to the scan line through the gate switching circuit. Gate electrodes of the first transistor and the second transistor are connected to each other, and the first transistor and the second transistor are a transistor with a control terminal in negative polarity conduction and a transistor with a control terminal in positive polarity conduction, respectively. Therefore, only one of the first sub-pixel and the second sub-pixel communicates and operates at the same time, and the first sub-pixel and the second sub-pixel are switched through the gate switching signal, and therefore, the problem of displaying the same image with the first sub-pixel and the second sub-pixel for a long time can be avoid, thereby reducing or even avoiding the occurrence of "burn-in".

Specifically, referring to FIG. 2, the gate switching signal A is a logic signal output by a TCON. The first transistor M1 is an N-type transistor in negative polarity conduction, is turned on when the gate signal thereof is L, and is turned off when the gate signal thereof is H. The second transistor M2 is an N-type transistor in positive polarity conduction, is turned on when the gate signal thereof is H, and is turned off when the gate signal thereof is L. The first transistor M1 and the second transistor M2 are located in a non-display region of the liquid crystal panel, and are produced by the common array process.

The scan line 20 receives a gate turn-on signal (Gate Output), which is output by the G-COF. A display pixel (the red sub-pixel, the green sub-pixel, the blue sub-pixel, the red sub-pixel in the figure) in the panel is divided into two parts, i.e., a and b. The first red sub-pixel R1*a*, the first green sub-pixel G1*a*, the first blue sub-pixel B1*a*, and the fourth red sub-pixel R2*b* are connected to corresponding first storage capacitor C1 of the first transistor M1; and the second red sub-pixel R1*b*, the second green sub-pixel G1*b*, the second blue sub-pixel B1*b*, and the third red sub-pixel R2*a* are connected to corresponding second storage capacitor C2 of the second transistor M2.

In actual application, the refresh rate of the panel display is 120 Hz or 60 Hz. Taking 120 Hz as an example, 120 images can be displayed per second.

When the TCON outputs a first image, in the first half of the turn-on time of each row, the gate switching signal A is output in low level L, and the TCON outputs the image normally. At this time, the first transistor M1 is turned on, and the second transistor M2 is turned off. The pixel connected to the first storage capacitor C1 can be normally displayed. In the second half of the turn-on time of each row, the gate switching signal A is output in high level H, and the TCON outputs a black image. At this time, the pixel connected to the second storage capacitor C2 is overwritten as a black image.

When the TCON outputs a next image, in the first half of the turn-on time of each row, the gate switching signal A is output in high level H, and the TCON outputs the image normally. At this time, the second transistor M2 is turned on, and the first transistor M1 is turned off. The pixel connected to the second storage capacitor C2 can be normally displayed. In the second half of the turn-on time of each row, the gate switching signal A is output in low level L, and the TCON outputs a black image. At this time, the pixel connected to the first storage capacitor C1 is overwritten as a black image.

In conclusion, each pixel will undergo both bright and dark states every other frame, avoiding the damage to the pixels caused by displaying the same picture for a long time, and finally avoiding the burn-in phenomenon.

Optionally, in this embodiment, the driving circuit 1 further includes a grounding control signal B for controlling communication with the data line 20 or the ground GND.

The switching circuit 30 further includes a grounding switching circuit 31, which includes a third transistor M3 and a fourth transistor M4; the third transistor M3 is a transistor with a control terminal in negative polarity conduction; and the fourth transistor M4 is a transistor with a control terminal in positive polarity conduction.

Gate electrodes of the third transistor M3 and fourth transistor M4 are connected to each other, and are connected to the grounding control signal B.

A source electrode of the third transistor M3 is grounded, and a drain electrode thereof is connected to the source terminals of the first sub-pixel and second sub-pixel.

A source electrode of the fourth transistor M4 is connected to the data line 20, and a drain electrode thereof is connected to the source terminals of the first sub-pixel and second sub-pixel.

The scan line 10 receives a gate signal (Gate Output); and the data line 20 receives a data signal (Source Output).

In this solution, the switching circuit further includes a third transistor and a fourth transistor for controlling communication with the data line or the ground. Under the control of the grounding control signal, the third transistor and the fourth transistor can coordinate the grounding control signal and the gate switching signal, so that the first sub-pixel or the second sub-pixel communicating with the scan line can simultaneously communicate with the data line to normally display the image; and the second sub-pixel or the first sub-pixel disconnected to the scan line is grounded to display the black image without communicating with the scan line. For example, the first sub-pixel can be controlled to display a normal image in the first half of the image and display a black image in the second half of the image, and the second sub-pixel can be controlled to display the black image in the first half of the image and display the normal image in the second half of the image. In this way, the first sub-pixel and the second sub-pixel can respectively undergo two states, i.e., bright and dark, in every frame, avoiding the damage to the pixels caused by displaying the same picture for a long time, and finally avoiding the burn-in phenomenon.

Specifically, referring to FIG. 3, in actual application, when the TCON outputs a current image, in the first half of the turn-on time of each row, the gate switching signal A is output in low level L, and the grounding control signal B is output in high level H. At this time, the first transistor M1 and the fourth transistor M4 are turned on, and the second transistor M2 and the third transistor M3 are turned off. The pixel connected to the first storage capacitor C1 can be normally displayed. In the second half of the turn-on time of each row, the gate switching signal A is output in high level H, and the grounding control signal B is output in low level L. At this time, the first transistor M1 and the fourth transistor M4 are turned off, and the second transistor M2 and the third transistor M3 are turned on. The pixel connected to the second storage capacitor C2 can be connected to the ground GND.

When the TCON outputs the next image, in the first half of the turn-on time of each row, the gate switching signal A is output in low level L, and the grounding control signal B is output in high level H. At this time, the first transistor M1 and the third transistor M3 are turned on, and the second transistor M2 and the fourth transistor M4 are turned off. The pixel connected to the first storage capacitor C1 can be connected to the ground GND, and thus, the display is a black image. In the second half of the turn-on time of each row, the gate switching signal A is output in high level H, and the grounding control signal B is output in high level H. At this time, the first transistor M1 and the third transistor M3 are turned on, and the second transistor M2 and the fourth transistor M4 are turned on. The pixel connected to the second storage capacitor C2 can be normally displayed.

In conclusion, each pixel will undergo both bright and dark states every other frame, avoiding the damage to the pixels caused by displaying the same picture for a long time, and finally avoiding the burn-in phenomenon.

Optionally, in this embodiment, the driving circuit 1 further includes a switching signal C for controlling the switching circuit 30.

The switching circuit 30 includes a first transistor M1, a second transistor M2, a third transistor M3, and a fourth transistor M4.

The first transistor M1 and the fourth transistor M4 are transistors with control terminals in positive polarity conduction; and the second transistor M2 and the third transistor M3 are transistors with control terminals in negative polarity conduction.

A source electrode of the first transistor M1 is connected to the data line 20, and a drain electrode thereof is connected to the source terminal of the first sub-pixel.

A source electrode of the second transistor M2 is connected to the data line 20, a drain electrode thereof is connected to the source terminal of the first sub-pixel, and a gate electrode thereof is connected to the switching signal C.

A source electrode of the third transistor M3 is grounded, and a drain electrode thereof is connected to the source terminal of the second sub-pixel.

A source electrode of the fourth transistor M4 is grounded, a drain electrode thereof is connected to the source terminal of the second sub-pixel, and a gate electrode thereof is connected to the switching signal.

Gate electrodes of the first transistor M1 and fourth transistor M4 are connected to each other, and are connected to the switching signal C.

The scan line 10 receives a gate signal (Gate Output); and the data line 20 receives a data signal (Source Output).

In this solution, the switching circuit includes a first transistor and a second transistor for controlling the first sub-pixel and the second sub-pixel to be connected to the data line, and further includes a third transistor and a fourth transistor for controlling communication with the data line or the ground. The gate electrodes of the first transistor, the second transistor, the third transistor, and the fourth transistor are connected to the switching signal. Since the first transistor and the fourth transistor are transistors with control terminals in positive polarity conduction, and the second transistor and the third transistor are transistors with control terminals in negative polarity conduction, under the control of the switching signal, one of the first sub-pixel and the second sub-pixel is controlled to communicate with the data line, while the other is grounded. For example, the first sub-pixel may be controlled to display a normal image in a first frame of two frames and display a black image in a second frame, and the second sub-pixel may be controlled to display a normal image in a second frame of the two frames and display the black image in the first frame. In this way, the first sub-pixel and the second sub-pixel can respectively undergo two states, i.e., bright and dark, in every two frames, avoiding the damage to the pixels caused by displaying the same picture for a long time, and finally avoiding the burn-in phenomenon.

Specifically, referring to FIG. 4, in actual application, the switching signal C is a logic signal output by the TCON. The second transistor M2 and the third transistor M3 are N-type transistors in negative polarity conduction, are turned on when the gate signals thereof are in low level L, and are turned off when the gate signals thereof are in high level H. The first transistor M1 and the fourth transistor M4 are N-type transistors in positive polarity conduction, are turned on when the gate signals thereof are in high level H, and are turned off when the gate signals thereof are in low level L. The first transistor M1, the second transistor M2, the third transistor M3, and the fourth transistor M4 are located in the non-display region of the liquid crystal panel, and are produced by the common array process. The scan line 20 receives a gate turn-on signal (Gate Output), which is output by the G-COF. The data line 10 receives a data signal (Source Output), which is a signal output by the S-COF to the pixel electrode. A display pixel (the red sub-pixel R1, the green sub-pixel G1, the blue sub-pixel B1, the red sub-pixel R2 in the figure) in the panel is divided into two parts, i.e., a and b. The two parts respectively include a first red sub-pixel R1*a* and a second red sub-pixel R1*b*, or respectively include a first red sub-pixel R1*a*, a first green sub-pixel G1*a*, and a first blue sub-pixel B1*a*, or a second red sub-pixel Rib, a second green sub-pixel G1*b*, and a second blue sub-pixel B1*b*.

A display pixel (the red sub-pixel, the green sub-pixel, the blue sub-pixel, the red sub-pixel in the figure) in the panel is divided into two parts, i.e., a and b. The first red sub-pixel Ria, the first green sub-pixel G1*a*, the first blue sub-pixel B1*a*, and the fourth red sub-pixel R2*b* are connected to corresponding first storage capacitor C1 of the first transistor M1; and the second red sub-pixel R1*b*, the second green sub-pixel G1*b*, the second blue sub-pixel Bib, and the third red sub-pixel R2*a* are connected to corresponding second storage capacitor C2 of the second transistor M2.

When the TCON outputs a first image, the TCON outputs the switching signal C in H, and at this time, M1 and M4 are turned on, and M2 and M3 are turned off. At this time, Source Output is connected to B1, and GND is connected to B2. At this time, R1*b* can normally display corresponding image output by the TCON, and R1*a* displays the black image because of being connected to the GND.

When the TCON outputs the next image, the TCON outputs C in low level L, and at this time, the second transistor M2 and the third transistor M3 are turned on, and the first transistor M1 and the fourth transistor M4 are turned off. At this time, the data line or the Source Output is connected to the first sub-pixel, and the ground GND is connected to the second sub-pixel. At this time, the first red sub-pixel R1*a* can normally display corresponding image output by the TCON, and the second red sub-pixel R1*b* displays the black image because of being connected to the GND.

In conclusion, each pixel will undergo both bright and dark states every other frame, avoiding the damage to the pixels caused by displaying the same picture for a long time, and finally avoiding the burn-n phenomenon.

Optionally, in this embodiment, the scan line 10 is simultaneously connected to the gate terminals of the first sub-pixel and second sub-pixel.

In this solution, by means of the switching circuit, in the case of using one scan line, the scan line can control the operations of the first sub-pixel and the second sub-pixel, separately. The first sub-pixel and the second sub-pixel may be two sub-pixels in the same pixel, and may also be two adjacent pixels.

Figure 5:
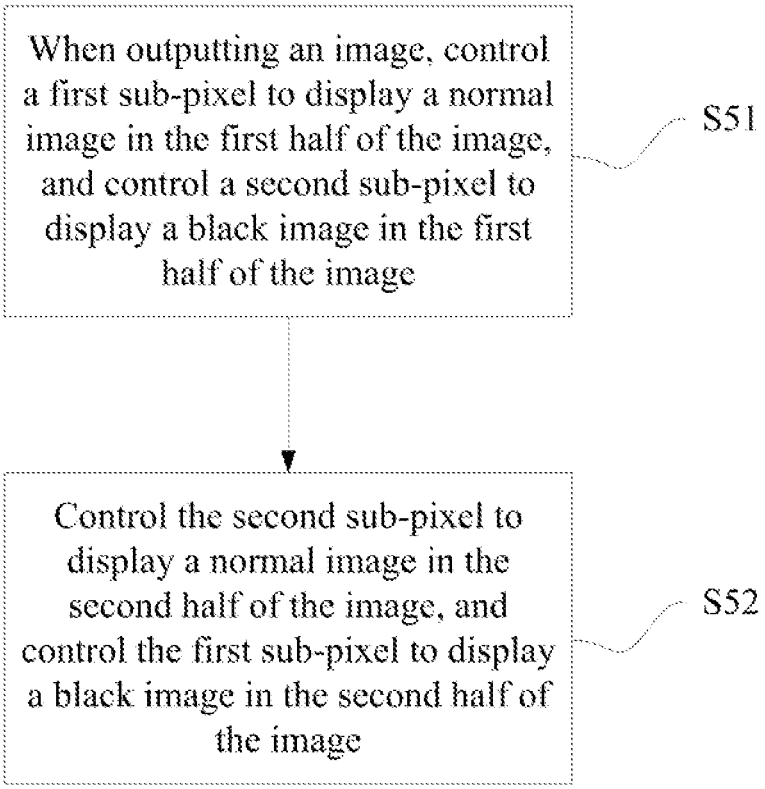
FIG. 5 is a flowchart of a driving method applicable to a driving circuit according to an embodiment of the present application.

FIG. 5 is a flowchart of a driving method applicable to a driving circuit according to an embodiment of the present application. Referring to FIG. 5, it can be known from FIGS. 1-4 that the present application further provides a driving method applicable to a driving circuit according to any one of the embodiments of the present application, including the following steps:

S51: When outputting an image, control a first sub-pixel to display a normal image in the first half of the image, and control a second sub-pixel to display a black image in the first half of the image.

S52: Control the second sub-pixel to display a normal image in the second half of the image, and control the first sub-pixel to display a black image in the second half of the image.

In this solution, the first sub-pixel and the second sub-pixel will undergo both bright and dark states in every frame, avoiding the damage to the pixels caused by displaying the same picture for a long time, and finally avoiding the "burn-in" phenomenon. Moreover, since the first sub-pixel and the second sub-pixel are respectively disconnected under the control of the switching circuit, the display switching of the first sub-pixel and the second sub-pixel of the present application does not affect the resolution of the display panel, and thus would not reduce the resolution.

Figure 6:
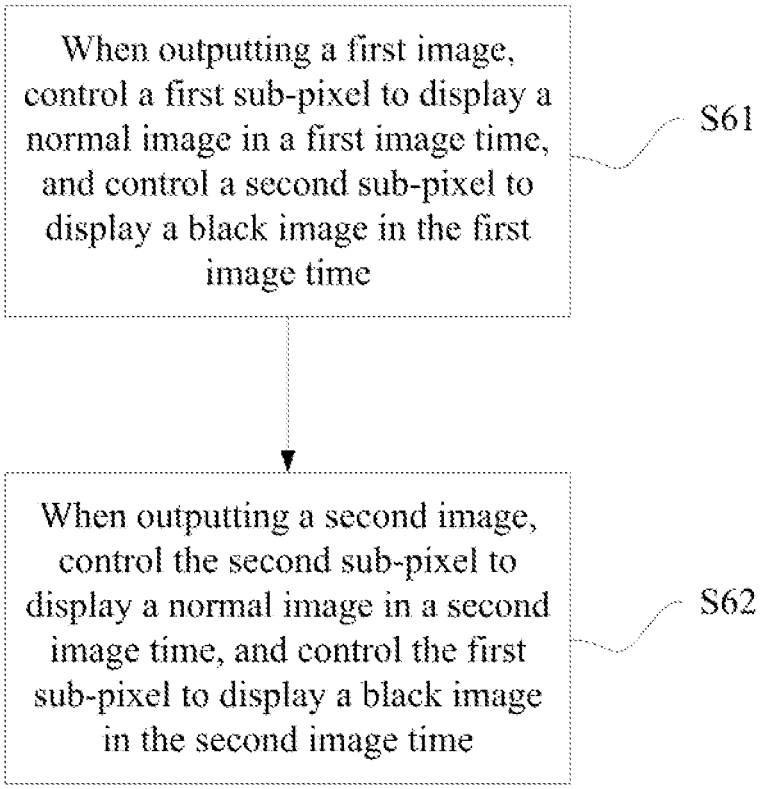
FIG. 6 is a flowchart of a driving method applicable to a driving circuit according to another embodiment of the present application.

FIG. 6 is a flowchart of a driving method applicable to another driving circuit according to an embodiment of the present application. Referring to FIG. 6, it can be known from FIGS. 1-5 that the present application further provides a driving method applicable to a driving circuit according to any one of the embodiments of the present application, including the following steps:

S61: When outputting a first image, control a first sub-pixel to display a normal image in a first image time, and control a second sub-pixel to display a black image in the first image time.

S62: When outputting a second image, control the second sub-pixel to display a normal image in a second image time, and control the first sub-pixel to display a black image in the second image time.

In this solution, the first sub-pixel and the second sub-pixel will undergo both bright and dark states in every other frame, avoiding the damage to the pixels caused by displaying the same picture for a long time, and finally avoiding the "burn-in" phenomenon. Moreover, since the first sub-pixel and the second sub-pixel are respectively disconnected under the control of the switching circuit, the display switching of the first sub-pixel and the second sub-pixel of the present application does not affect the resolution of the display panel, and thus would not reduce the resolution.

Figure 7:
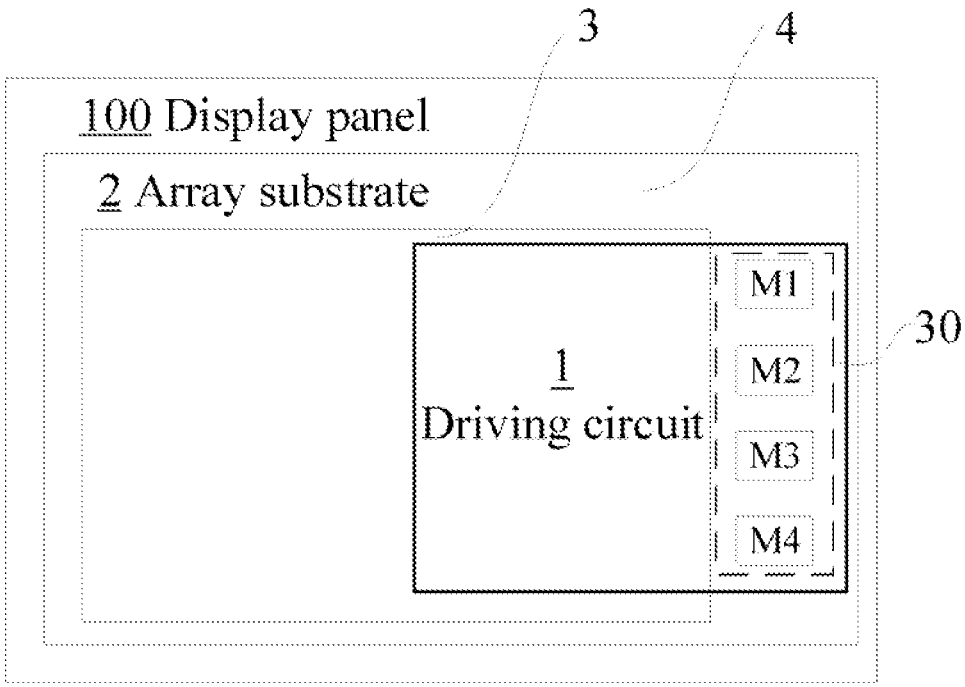
FIG. 7 is a schematic diagram of a display panel according to an embodiment of the present application.

FIG. 7 is a schematic diagram of a display panel according to the present application. Referring to FIG. 7, it can be known from FIGS. 1-6 that:

The present application further provides a display panel, including the driving circuit 1 disclosed in the present application.

The display panel 100 further includes an array substrate 2, which includes a display region 3 and a non-display region 4.

The display panel 100 further includes an array substrate 2, which includes a display region 3 and a non-display region 4.

The switching circuit 30 is provided in the non-display region 4.

The switching circuit 30 and the array substrate 2 are produced by the common array process.

Specifically, the switching circuit 30 may include at least one of a first transistor M1, a second transistor M2, a third transistor M3, and a fourth transistor M4.

The first transistor, the second transistor, the third transistor, the fourth transistor and the array substrate are produced by the common array process.

The display panel of the present application includes a novel driving circuit. According to the driving circuit, the first sub-pixel and the second sub-pixel are respectively connected to the same scan line and the same data line, and a switching circuit is provided to switch the conduction relations of the first sub-pixel and the second sub-pixel to the scan line and the data line. In this way, during operation, the driving circuit can control that one of the sub-pixels is connected to the scan line and the data line, and the other sub-pixel is not connected, or the two sub-pixels are connected to the scan line and the data line. In this way, the first sub-pixel and the second sub-pixel are controlled to operate respectively through a scan line and a data line, thereby saving the use of the scan line and the data line. Moreover, if necessary, one of the first sub-pixel and the second sub-pixel is disconnected to the scan line and the data line, and thus, the problem of "burn-in" caused by displaying the same image with the first sub-pixel and the second sub-pixel for a long time can be reduced, thereby prolonging the service life of the display panel.

The panel of the present application may be an OLED panel, and of course, may be a Twisted Nematic (TN) panel, an In-Plane Switching (IPS) panel, and a Multi-domain Vertical Alignment (VA) panel, and of course, may also be other types of panels, such as an OLED display panel, if appropriate.

The contents above are detailed descriptions of the present application in conjunction with specific preferred embodiments, and the specific implementation of the present application is not limited to these descriptions. It will be apparent to a person of ordinary skill in the art that various simple deductions or substitutions may be made without departing from the spirit of the present application, and should be considered to fall into the scope of protection of the present application.

What is claimed is:

1. A driving circuit, comprising:

a plurality of pixels, each pixel including a first sub-pixel and a second sub-pixel;

a scan line connected to gate terminals of the first sub-pixel and second sub-pixel;

a data line connected to source terminals of the first sub-pixel and second sub-pixel; and a switching circuit configured to switch connection relations of the scan line, the data line, the first sub-pixel and the second sub-pixel so that one or both of the first sub-pixel and the second sub-pixel communicate with the scan line and the data line;

wherein the driving circuit also comprising a switching signal for controlling the switching circuit;

the switching circuit comprises a first transistor, a second transistor, a third transistor, and a fourth transistor;

the first transistor and the fourth transistor are transistors with control terminals in positive polarity conduction; and the second transistor and the third transistor are transistors with control terminals in negative polarity conduction;

a source electrode of the first transistor is connected to the data line, and a drain electrode thereof is connected to the source terminal of the second sub-pixel;

a source electrode of the second transistor is connected to the data line, a drain electrode thereof is connected to the source terminal of the first sub-pixel, and a gate electrode thereof is connected to the switching signal;

a source electrode of the third transistor is grounded, and a drain electrode thereof is connected to the source terminal of the second sub-pixel;

a source electrode of the fourth transistor is grounded, a drain electrode thereof is connected to the source terminal of the first sub-pixel, and a gate electrode thereof is connected to the switching signal; and gate electrodes of the first transistor and fourth transistor are connected to each other, and are connected to the switching signal.

2. The driving circuit according to claim 1, wherein the pixel further comprises a third sub-pixel, a fourth sub-pixel, a fifth sub-pixel, and a sixth sub-pixel;

the first sub-pixel and the second sub-pixel are red sub-pixels; the third sub-pixel and the fourth sub-pixel are green sub-pixels; and the fifth sub-pixel and the sixth sub-pixel are blue sub-pixels.

3. The driving circuit according to claim 2, wherein the scan line is simultaneously connected to the gate terminals of the first sub-pixel and second sub-pixel.

4. The driving circuit according to claim 1, wherein the first sub-pixel and the second sub-pixel respectively comprise a red sub-pixel, a green sub-pixel, and a blue sub-pixel.

5. The driving circuit according to claim 4, wherein the scan line is simultaneously connected to the gate terminals of the first sub-pixel and second sub-pixel.

6. The driving circuit according to claim 1, wherein the scan line is simultaneously connected to the gate terminals of the first sub-pixel and second sub-pixel.

7. The driving circuit according to claim 1, wherein the switching signal is a logic signal output by a timing controller.

8. The driving circuit according to claim 1, wherein a gate electrodes of the third transistor is connected to the switching signal.

9. The driving circuit according to claim 1, wherein the first sub-pixel and the second sub-pixel are two sub-pixels in a same pixel.

* * * * *